US009064406B1

(12) United States Patent
Stevens et al.

(10) Patent No.: US 9,064,406 B1
(45) Date of Patent: Jun. 23, 2015

(54) PORTABLE AND PERSISTENT VEHICLE SURVEILLANCE SYSTEM

(75) Inventors: Patricia W. Stevens, West Chester, PA (US); Karol Grabczewski, Wilmington, DE (US); Kenneth Leonard Bernier, O'Fallon, MO (US); Neil F. Ruggieri, Florissant, MO (US); Robert G. Becnel, Imperial, MO (US); Joe B. Russek, Fenton, MO (US)

(73) Assignee: THE BOEING COMPANY, Chicago, IL (US)

( * ) Notice: Subject to any disclaimer, the term of this patent is extended or adjusted under 35 U.S.C. 154(b) by 389 days.

(21) Appl. No.: 12/892,040

(22) Filed: Sep. 28, 2010

(51) Int. Cl.
*G08G 1/00* (2006.01)

(52) U.S. Cl.
CPC ..... *G08G 1/00* (2013.01)

(58) Field of Classification Search
CPC ..... G08G 1/00; G08G 1/167; G08G 1/16; G08G 1/163; G08G 1/08; G08G 1/054; G08G 1/052; G08G 1/0175
USPC ..... 348/148
See application file for complete search history.

(56) References Cited

U.S. PATENT DOCUMENTS

| | | | | | |
|---|---|---|---|---|---|
| 3,964,063 | A | | 6/1976 | Narbaits-Jaureguy et al. | |
| 4,817,166 | A | * | 3/1989 | Gonzalez et al. | 382/105 |
| 5,691,724 | A | | 11/1997 | Aker et al. | |
| 5,935,190 | A | * | 8/1999 | Davis et al. | 701/119 |
| 5,991,102 | A | * | 11/1999 | Oono et al. | 359/820 |
| 6,081,206 | A | * | 6/2000 | Kielland | 340/937 |
| 6,262,764 | B1 | | 7/2001 | Perterson | |
| 7,227,494 | B2 | | 6/2007 | Aker | |
| 7,504,965 | B1 | * | 3/2009 | Windover et al. | 340/937 |
| 2002/0186148 | A1 | * | 12/2002 | Trajkovic et al. | 340/936 |
| 2003/0174865 | A1 | * | 9/2003 | Vernon | 382/105 |
| 2006/0012685 | A1 | * | 1/2006 | Gannon | 348/211.2 |
| 2006/0120602 | A1 | * | 6/2006 | Tang et al. | 382/176 |
| 2006/0221229 | A1 | * | 10/2006 | Ogawa et al. | 348/367 |
| 2006/0269104 | A1 | * | 11/2006 | Ciolli | 382/104 |
| 2008/0192233 | A1 | * | 8/2008 | Rosania | 356/51 |
| 2009/0102924 | A1 | * | 4/2009 | Masten, Jr. | 348/155 |
| 2009/0322874 | A1 | * | 12/2009 | Knutson et al. | 348/143 |
| 2010/0117864 | A1 | * | 5/2010 | Makukhin | 340/936 |
| 2010/0128127 | A1 | * | 5/2010 | Ciolli | 348/143 |
| 2010/0245125 | A1 | * | 9/2010 | Wike et al. | 340/928 |
| 2011/0123068 | A1 | * | 5/2011 | Miksa et al. | 382/105 |
| 2011/0293141 | A1 | * | 12/2011 | Robert et al. | 382/103 |
| 2012/0063737 | A1 | * | 3/2012 | Gregoire | 386/224 |

FOREIGN PATENT DOCUMENTS

KR 2009035393 A * 4/2009

* cited by examiner

*Primary Examiner* — Christopher S Kelley
*Assistant Examiner* — Deirdre Beasley
(74) *Attorney, Agent, or Firm* — Yee & Associates, P.C.

(57) ABSTRACT

A method and apparatus for monitoring vehicles. The vehicles are monitored using a sensor unit. The sensor unit comprises a housing, a camera system, a wireless communications system, and a controller associated with the housing. The camera system has a field of view and is configured to generate images. The wireless communications system is configured to transmit wireless signals. The controller is configured to detect a number of vehicles in the images, generate information for the number of vehicles, and send the information in the wireless signals. The information for the number of vehicles is sent to a remote location.

27 Claims, 7 Drawing Sheets

PORTABLE AND PERSISTENT VEHICLE SURVEILLANCE SYSTEM

BACKGROUND INFORMATION

1. Field

The present disclosure relates generally to surveillance and, in particular, to monitoring for objects of interest. Still more particularly, the present disclosure relates to a method and apparatus for monitoring traffic and identifying vehicles.

2. Background

Video surveillance of traffic is commonly performed. For example, camera systems are often used to obtain images of license plates on vehicles in various areas. For example, camera systems are used on toll roads for collection of tolls. The camera systems obtain images of license plates for vehicles passing through toll booths. Optical character recognition processes are used to identify license plates in the images for the vehicles. With the identification of the license plates, tolls may be applied to different vehicles passing through the toll booths.

Additionally, video camera systems also are used to monitor traffic at different locations. For example, a camera system may be used at an intersection to determine whether vehicles are adhering to traffic signals, such as red lights. As another example, camera systems may be placed at different locations on roadways to monitor traffic congestion.

In some cases, mobile camera systems are used. For example, a police vehicle may employ a camera system with a license plate recognition process running on a computer in the police vehicle. The license plate recognition process identifies the license plates in the images taken by the camera system. This information is compared with a database in the computer in the police vehicle to identify vehicles of interest.

Currently available surveillance systems may not provide the desired flexibility for monitoring traffic in all situations. For example, in some cases, it may be desirable to monitor traffic in an area covertly. Currently available systems typically have used cameras mounted in locations that may be more easily identified than desired. For example, in some cases, camera systems for monitoring traffic are often located on overpasses, light poles, signal lights, and other locations. Some portable surveillance systems are integrated into police vehicles or other vehicles.

Therefore, it would be advantageous to have a method and apparatus that takes into account at least some of the issues discussed above, as well as other possible issues.

SUMMARY

In one advantageous embodiment, an apparatus comprises a housing, a camera system, a light source, a lens system, a wireless communications system, a controller, and a power source. The camera system, the light source, the lens system, the wireless communications system, and the controller are associated with the housing. The camera system has a field of view and is configured to generate images. The light source is configured to generate a light beam that is substantially collimated. The lens system is associated with the light source. The lens system is configured to cause the light beam to diverge with an angle that covers the field of view for the camera system. The wireless communications system is configured to transmit wireless signals. The controller is configured to detect a number of vehicles in the images, generate information for the number of vehicles, and send the information in the wireless signals transmitted by the wireless communications system. The power source is configured to provide power to the camera system, the light source, the wireless communications system, and the controller.

In another advantageous embodiment, an apparatus comprises a housing, a camera system, a wireless communications system, a controller, and a power source. The camera system, the wireless communications system, the power source, and the controller are associated with the housing. The camera system has a field of view and is configured to generate images. The wireless communications system is configured to transmit wireless signals. The controller is configured to detect a number of vehicles in the images, identify license plate numbers for the number of vehicles, send the license plate numbers in the wireless signals sent by the wireless communications system, receive a request for a number of images for a particular vehicle of interest in the number of vehicles from a requestor, and send the number of images for the particular vehicle of interest to the requestor. The power source is configured to provide power to the camera system, the controller, and the wireless communications system.

In yet another advantageous embodiment, a method is provided for monitoring vehicles. The vehicles are monitored using a sensor unit. The sensor unit comprises a housing, a camera system, a light source, a lens system, a wireless communications system, a controller, and a power source. The camera system, the light source, the lens system, the wireless communications system, the controller, and the power source are associated with the housing. The camera system has a field of view and is configured to generate images. The light source is configured to generate a light beam that is substantially collimated. The lens system is associated with the light source and is configured to cause the light beam to diverge with an angle that covers the field of view for the camera system. The wireless communications system is configured to transmit wireless signals. The controller is configured to detect a number of vehicles in the images, generate information for the number of vehicles, and send the information in the wireless signals transmitted by the wireless communications system. The power source is configured to provide power to the camera system, the light source, the wireless communications system, and the controller. The information for the number of vehicles is sent to a remote location.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and advantages thereof, will best be understood by reference to the following detailed description of an illustrative embodiment of the present disclosure when read in conjunction with the accompanying drawings, wherein:

DETAILED DESCRIPTION

The different illustrative embodiments recognize and take into account a number of different considerations. The different illustrative embodiments recognize and take into account that, in some cases, it would be desirable to have a video monitoring system that has a size and portability that allows for the video surveillance system to be placed in locations that may make it hard to identify the video monitoring system as compared to currently used locations.

The different illustrative embodiments also recognize and take into account that currently available systems may have a limited number of locations in which the systems may be deployed. For example, the different illustrative embodiments recognize and take into account that cameras for the video monitoring systems require power supplies. As a result, the deployment of these systems may be limited with respect to availability of power at different locations.

The different illustrative embodiments also recognize and take into account that, in some cases, portable power supplies may be used. For example, the different illustrative embodiments recognize and take into account that, often times, the video surveillance system may have a portable generator that runs on fuel. These types of video monitoring systems, however, may have a size that may be greater than desired with respect to concealment.

For example, video monitoring systems may be placed on a trailer that may be moved to different locations. The trailer, however, may have a size that is greater than desired to avoid detection. Further, the power generator may create noise that also may indicate the presence of the video monitoring system.

Thus, the different illustrative embodiments provide a method and apparatus for monitoring for vehicles. In one illustrative embodiment, an apparatus comprises a housing, a camera system, a light source, a lens system, a wireless communication system, a controller, and a power source. The camera system, the light source, the lens system, the wireless communication system, the controller, and the power source are associated with the housing.

The camera system has a field of view and is configured to generate images. The light source is configured to generate a light beam that is substantially collimated in these illustrative examples. The lens system is associated with the light source and is configured to cause the light beam to diverge with an angle that covers the field of view for the camera system. The wireless communication system is configured to transmit wireless signals. The controller is configured to detect a number of vehicles in the images, generate information for the number of vehicles, and send the information in the wireless signals transmitted by the wireless communication system. The power source provides power to the camera system, the light source, the controller, and the wireless communication system, in these illustrative examples.

Figure 1:
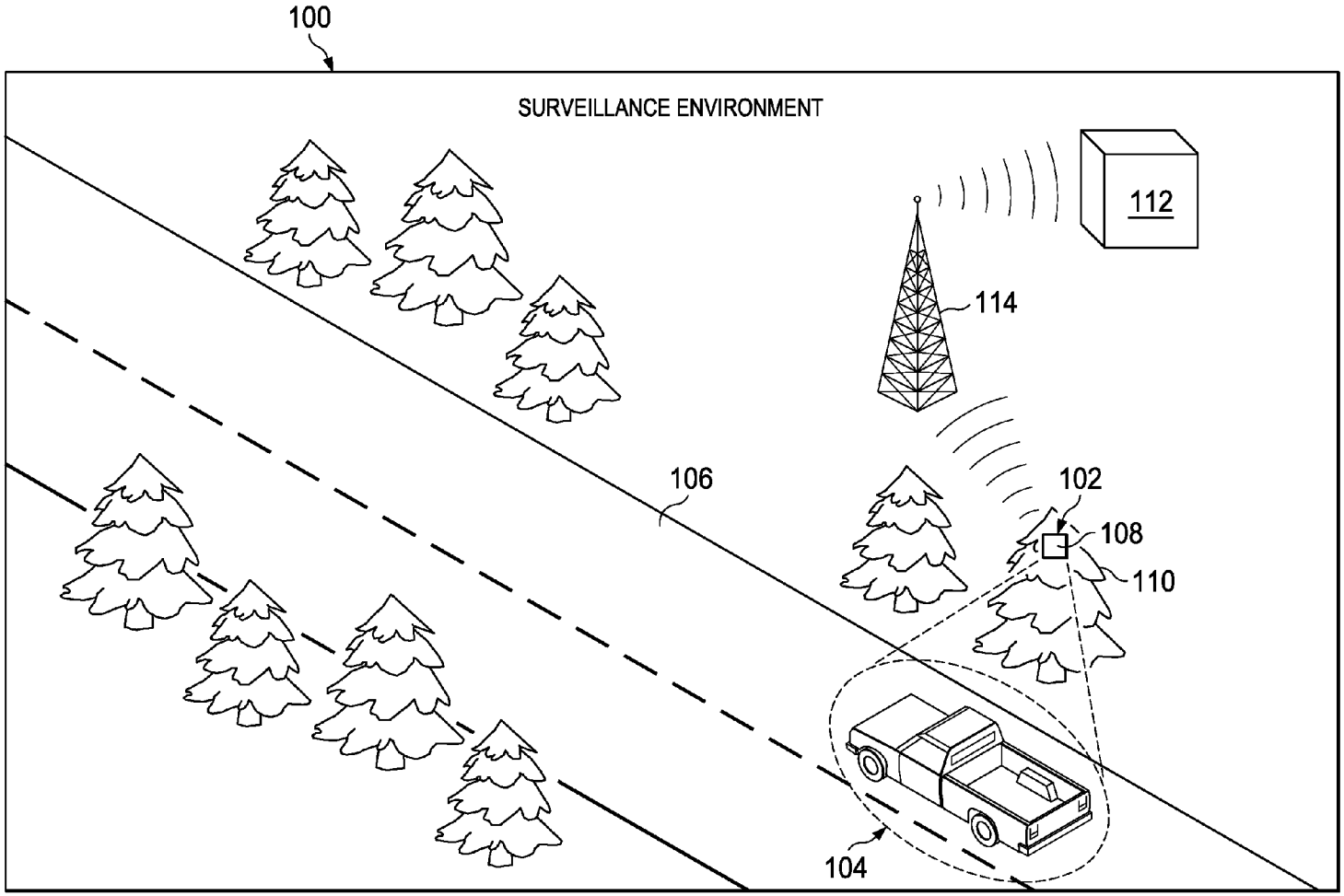
FIG. 1 is an illustration of a surveillance environment in accordance with an illustrative embodiment.

With reference now to FIG. 1, an illustration of a surveillance environment is depicted in accordance with an illustrative embodiment. In this illustrative example, video monitoring system 102 is used in surveillance environment 100 to monitor area 104 of road 106. In these examples, video monitoring system 102 includes sensor unit 108. Sensor unit 108 is positioned in tree 110 to provide sensor unit 108 a view of area 104 of road 106.

The placement of sensor unit 108 in tree 110 may provide concealment for sensor unit 108. In this manner, people that may be in area 104 of road 106 may be less likely to detect the presence of sensor unit 108.

Further, sensor unit 108, in these illustrative examples, is self-contained. In other words, sensor unit 108 does not need to connect to a power source or have a physical connection to a communications network to monitor area 104 of road 106. Further, sensor unit 108 also may have a size that may be suitable for placing sensor unit 108 in various locations that may decrease the detectability of sensor unit 108.

In these illustrative examples, sensor unit 108 sends information generated from monitoring area 104 of road 106 to remote location 112. The information is processed at remote location 112 in these illustrative examples. In these illustrative examples, sensor unit 108 transmits information to remote location 112 through wireless signals. In particular, the same wireless signals used for wireless communications, such as with mobile phones, may be used.

Additionally, in this illustrative example, range extension unit 114 may be used to extend the range at which sensor unit 108 transmits information to remote location 112. Of course, in other examples, sensor unit 108 may transmit the information to remote location 112 without needing to use range extension unit 114.

Figure 2:
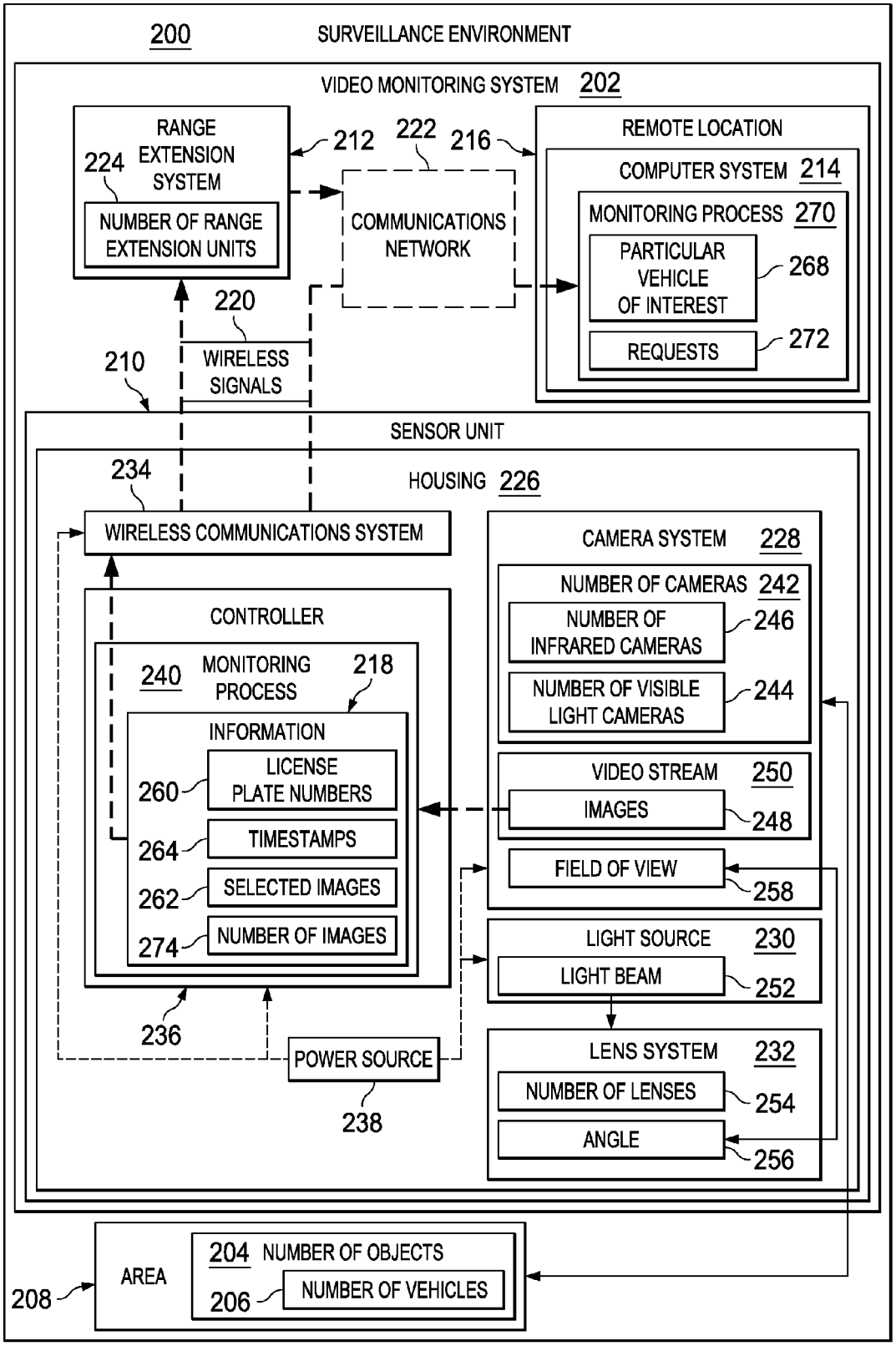
FIG. 2 is an illustration of a surveillance environment in accordance with an illustrative embodiment.

With reference now to FIG. 2, an illustration of a surveillance environment is depicted in accordance with an illustrative embodiment. Surveillance environment 100 in FIG. 1 is an example of one implementation of surveillance environment 200 in FIG. 2.

In this illustrative example, video monitoring system 202 is used in surveillance environment 200 to monitor number of objects 204 that may be present. A number, as used herein with reference to items, means one or more items. For example, a number of objects is one or more objects.

In these examples, number of objects 204 is number of vehicles 206. In particular, number of vehicles 206 may take the form of ground vehicles such as cars, trucks, motorcycles, and other suitable types of ground vehicles. In this illustrative example, video monitoring system 202 may monitor area 208 in surveillance environment 200.

In this illustrative example, video monitoring system 202 includes sensor unit 210, range extension system 212, and computer system 214 at remote location 216. Sensor unit 210 is configured to generate information 218 for number of vehicles 206 detected in area 208. In these illustrative examples, information 218 is sent to computer system 214 at remote location 216 through wireless signals 220. In these illustrative examples, wireless signals 220 may be cellular or mobile phone wireless signals. Wireless signals 220 may be, for example, sent over communications network 222 to computer system 214 in remote location 216.

In some cases, range extension system 212 may be used to extend the range of wireless signals 220 if sensor unit 210 is outside of a distance for transmitting wireless signals 220 to communications network 222. Range extension system 212 comprises number of range extension units 224. Each range extension unit in number of range extension units 224 is configured to receive wireless signals 220, amplify wireless signals 220, and transmit wireless signals 220 in their amplified form to communications network 222.

In these illustrative examples, sensor unit 210 comprises housing 226, camera system 228, light source 230, lens system 232, wireless communications system 234, controller 236, and power source 238. Camera system 228, light source 230, wireless communications system 234, controller 236, and power source 238 are associated with housing 226.

A first component, such as camera system 228, may be considered to be associated with a second component, such as housing 226, by being secured to the second component, bonded to the second component, fastened to the second component, and/or connected to the second component in some other suitable manner. The first component also may be connected to the second component using a third component. The first component may also be considered to be associated with the second component by being formed as part of and/or an extension of the second component.

Housing 226 is any structure configured to hold the various components. Further, housing 226 also may be configured to withstand environmental conditions. These environmental conditions may include, for example, without limitation, heat, cold, wind, rain, and/or other environmental conditions that may occur during the use of sensor unit 210.

Further, housing 226 is portable in these illustrative examples. In other words, housing 226 may be moved from one location to another location for use. The portability of housing 226 is configured to allow for the placement of housing 226 in various locations to aid in reducing the detectability of housing 226.

For example, housing 226 and the different components associated with housing 226 are configured to have a size, a shape, weight, or combination thereof that allows for placement of housing 226 in a location, such as in a tree, on the ground, on a light pole, on a power line, or in some other suitable location.

Housing 226 may be made of a number of different materials. For example, housing 226 may be comprised of materials selected from at least one of plastic, polyvinyl chloride, aluminum, steel, metal, a metal alloy, and other suitable types of materials. As used herein, the phrase "at least one of", when used with a list of items, means that different combinations of one or more of the listed items may be used and only one of each item in the list may be needed. For example, "at least one of item A, item B, and item C" may include, for example, without limitation, item A or item A and item B. This example also may include item A, item B, and item C or item B and item C.

In these illustrative examples, camera system 228 comprises number of cameras 242. Number of cameras 242 comprises at least one of number of visible light cameras 244, number of infrared cameras 246, and other suitable types of cameras. Number of cameras 242 generates images 248. Images 248 may form video stream 250.

In these illustrative examples, number of visible light cameras 244 generates images 248 by detecting light having a wavelength from about 380 nanometers to about 780 nanometers. Number of infrared cameras 246 generates images 248 by detecting light having a wavelength from about 0.7 micrometers to about 300 micrometers.

Light source 230 is configured to generate light beam 252 that is substantially collimated. For example, light source 230 may be a laser unit and light beam 252 may be a laser beam. In these illustrative examples, lens system 232 is configured to diffuse light beam 252 generated by light source 230. Lens system 232 is associated with light source 230.

In these illustrative examples, lens system 232 comprises number of lenses 254. Number of lenses 254 is configured to cause light beam 252 to diverge with angle 256. Angle 256 is configured to cover field of view 258 for camera system 228. Field of view 258 is the extent of surveillance environment 200 that can be detected by camera system 228. Field of view 258 is measured in angles in these illustrative examples.

With the use of light source 230 to generate light beam 252 that is substantially collimated and the use of number of lenses 254 to diffuse light beam 252 such that angle 256 for light beam 252 covers field of view 258 of camera system 228, the distance at which camera system 228 can detect number of objects 204 is increased as compared to currently used lighting systems.

Currently used lighting systems use light emitting diodes or light that is existing. These currently used systems may provide a range of about 25 feet for the distance at which number of vehicles 206 can be detected by camera system 228 in sensor unit 210. With the use of light source 230 generating light beam 252 in substantially collimated form and number of lenses 254 diffusing light beam 252 as described above, the distance at which number of vehicles 206 can be detected may be increased to about 200 meters.

In these illustrative examples, light beam 252 may have different wavelengths. Light beam 252 is configured to have a wavelength that is detectable by number of cameras 242 in camera system 228. For example, light beam 252 may have a wavelength selected from at least one of about 380 nanometers to about 780 nanometers and from about 0.7 micrometers to about 300 micrometers.

Wireless communications system 234 is configured to transmit information 218 generated by controller 236 in these illustrative examples. Wireless communications system 234 transmits information 218 in the form of wireless signals 220 in these illustrative examples.

Controller 236 may take a number of different forms. For example, without limitation, controller 236 may be a computer, a processor unit, or some other suitable type of controller. Controller 236 is configured to detect number of vehicles 206. Further, controller 236 is configured to generate information 218 for number of vehicles 206 and send information 218 in wireless signals 220 using wireless communications system 234. Controller 236 performs these different operations using monitoring process 240 running on controller 236.

Monitoring process 240 may be run on controller 236 in a number of different ways. For example, monitoring process 240 may be implemented in program code run by controller 236. In other illustrative examples, monitoring process 240 may be implemented in hardware in controller 236. In yet other implementations, monitoring process 240 may be implemented using a combination of program code and hardware.

In these illustrative examples, information 218 may take a number of different forms. For example, without limitation, information 218 may include license plate numbers 260 for number of vehicles 206, selected images 262 from images 248, timestamps 264, and/or other suitable types of information that may be useful.

In these illustrative examples, license plate numbers 260 are sent in information 218 through wireless signals 220 as license plate numbers 260 are generated. In other words, as license plate numbers 260 are identified in images 248, license plate numbers 260 are transmitted.

In this manner, license plate numbers 260 are not intentionally delayed before transmission in these illustrative examples. The only delay that may occur is the delay that is needed to transmit license plate numbers 260. For example, the time needed to place license plate numbers 260 in packets for transmission in wireless signals 220, as well as the time needed to place the packets in buffers until the packets can be transmitted, are not considered intentional delays in these illustrative examples.

Additionally, selected images 262 are sent periodically in information 218 in wireless signals 220. For example, selected images 262 may be sent every five seconds while license plate numbers 260 are sent continuously in these illustrative examples.

When computer system 214 in remote location 216 receives information 218, computer system 214 identifies particular vehicle of interest 268 from processing information 218. In these illustrative examples, the processing of information 218 in computer system 214 may be performed using monitoring process 270.

Monitoring process 270 running on computer system 214 may send requests 272 to monitoring process 240 running on controller 236. Requests 272 are for additional information about particular vehicle of interest 268.

This additional information may be, for example, number of images 274 of particular vehicle of interest 268. Number of images 274 may include images taken before and/or after the image used to identify a license plate number for particular vehicle of interest 268 in these depicted examples. Number of images 274 is identified from images 248 and sent in information 218 in wireless signals 220 back to the requestor, or monitoring process 270.

In these illustrative examples, power source 238 is configured to provide power to the different components in sensor unit 210. Power source 238 may take a number of different forms. For example, without limitation, power source 238 may be selected from at least one of a fuel cell, a battery, an energy harvesting device, a thermoelectric generator, a micro wind turbine system, a solar cell system, and other suitable types of power sources.

In this manner, sensor unit 210 provides increased flexibility and desirability for use in monitoring for number of vehicles 206. In these illustrative examples, sensor unit 210 may be self-contained such that connections to power sources and physical connections to communications networks are unnecessary for monitoring for number of vehicles 206 and transmitting information 218 to remote location 216.

Further, in these illustrative examples, the identification of vehicles from license plate numbers is performed by monitoring process 270 running on computer system 214 in remote location 216. The need for a database and/or other software to identify vehicles is unnecessary in these illustrative examples.

The illustration of surveillance environment 200 in FIG. 2 is not meant to imply physical or architectural limitations to a manner in which different illustrative embodiments may be implemented. Other components in addition and/or in place of the ones illustrated may be used. Some components may be unnecessary in some illustrative embodiments. Also, the blocks are presented to illustrate some functional components. One or more of these blocks may be combined and/or divided into different blocks when implemented in different illustrative embodiments.

For example, in some illustrative examples surveillance environment 200 may include additional sensor units in addition to sensor unit 210. Further, in some illustrative examples, range extension system 212 may be unnecessary.

Figure 3:
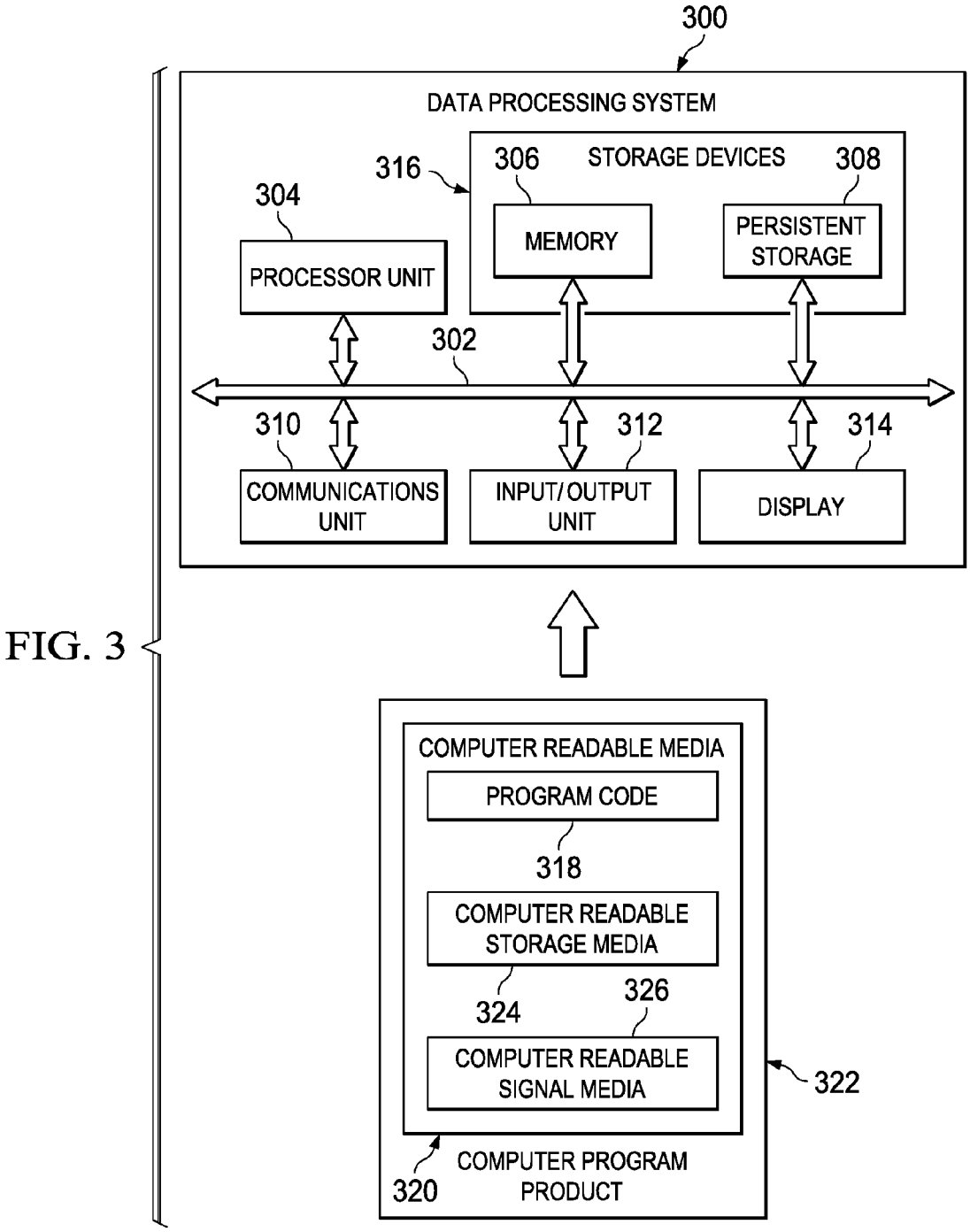
FIG. 3 is an illustration of a data processing system in accordance with an illustrative embodiment.

Turning now to FIG. 3, an illustration of a data processing system is depicted in accordance with an illustrative embodiment. Data processing system 300 in FIG. 3 is an example of a data processing system that may be used to implement computer system 214 and controller 236 in FIG. 2. In this illustrative example, data processing system 300 includes communications fabric 302, which provides communications between processor unit 304, memory 306, persistent storage 308, communications unit 310, input/output (I/O) unit 312, and display 314.

Processor unit 304 serves to execute instructions for software that may be loaded into memory 306. Processor unit 304 may be a number of processors, a multi-processor core, or some other type of processor, depending on the particular implementation. A number, as used herein with reference to an item, means one or more items. Further, processor unit 304 may be implemented using a number of heterogeneous processor systems in which a main processor is present with secondary processors on a single chip. As another illustrative example, processor unit 304 may be a symmetric multi-processor system containing multiple processors of the same type.

Memory 306 and persistent storage 308 are examples of storage devices 316. A storage device is any piece of hardware that is capable of storing information, such as, for example, without limitation, data, program code in functional form, and/or other suitable information either on a temporary basis and/or a permanent basis. Storage devices 316 may also be referred to as computer readable storage devices in these examples. Memory 306, in these examples, may be, for example, a random access memory or any other suitable volatile or non-volatile storage device. Persistent storage 308 may take various forms, depending on the particular implementation.

For example, persistent storage 308 may contain one or more components or devices. For example, persistent storage 308 may be a hard drive, a flash memory, a rewritable optical disk, a rewritable magnetic tape, or some combination of the above. The media used by persistent storage 308 also may be removable. For example, a removable hard drive may be used for persistent storage 308.

Communications unit 310, in these examples, provides for communications with other data processing systems or devices. In these examples, communications unit 310 is a network interface card. Communications unit 310 may provide communications through the use of either or both physical and wireless communications links.

Input/output unit 312 allows for input and output of data with other devices that may be connected to data processing system 300. For example, input/output unit 312 may provide a connection for user input through a keyboard, a mouse, and/or some other suitable input device. Further, input/output unit 312 may send output to a printer. Display 314 provides a mechanism to display information to a user.

Instructions for the operating system, applications, and/or programs may be located in storage devices 316, which are in communication with processor unit 304 through communications fabric 302. In these illustrative examples, the instructions are in a functional form on persistent storage 308. These instructions may be loaded into memory 306 for execution by processor unit 304. The processes of the different embodiments may be performed by processor unit 304 using computer implemented instructions, which may be located in a memory, such as memory 306.

These instructions are referred to as program code, computer usable program code, or computer readable program code that may be read and executed by a processor in processor unit 304. The program code in the different embodiments may be embodied on different physical or computer readable storage media, such as memory 306 or persistent storage 308.

Program code 318 is located in a functional form on computer readable media 320 that is selectively removable and may be loaded onto or transferred to data processing system 300 for execution by processor unit 304. Program code 318 and computer readable media 320 form computer program product 322 in these examples. In one example, computer readable media 320 may be computer readable storage media 324 or computer readable signal media 326.

Computer readable storage media 324 may include, for example, an optical or magnetic disk that is inserted or placed into a drive or other device that is part of persistent storage 308 for transfer onto a storage device, such as a hard drive, that is part of persistent storage 308. Computer readable storage media 324 also may take the form of a persistent storage, such as a hard drive, a thumb drive, or a flash memory, that is connected to data processing system 300. In some instances, computer readable storage media 324 may not be removable from data processing system 300. In these illustrative examples, computer readable storage media 324 is a non-transitory computer readable storage medium.

Alternatively, program code 318 may be transferred to data processing system 300 using computer readable signal media 326. Computer readable signal media 326 may be, for example, a propagated data signal containing program code 318. For example, computer readable signal media 326 may be an electromagnetic signal, an optical signal, and/or any other suitable type of signal. These signals may be transmitted over communications links, such as wireless communications links, optical fiber cable, coaxial cable, a wire, and/or any other suitable type of communications link. In other words, the communications link and/or the connection may be physical or wireless in the illustrative examples.

In some illustrative embodiments, program code 318 may be downloaded over a network to persistent storage 308 from another device or data processing system through computer readable signal media 326 for use within data processing system 300. For instance, program code stored in a computer readable storage medium in a server data processing system may be downloaded over a network from the server to data processing system 300. The data processing system providing program code 318 may be a server computer, a client computer, or some other device capable of storing and transmitting program code 318.

The different components illustrated for data processing system 300 are not meant to provide architectural limitations to the manner in which different embodiments may be implemented. The different illustrative embodiments may be implemented in a data processing system including components in addition to or in place of those illustrated for data processing system 300. Other components shown in FIG. 3 can be varied from the illustrative examples shown. The different embodiments may be implemented using any hardware device or system capable of running program code. As one example, the data processing system may include organic components integrated with inorganic components and/or may be comprised entirely of organic components excluding a human being. For example, a storage device may be comprised of an organic semiconductor.

In another illustrative example, processor unit 304 may take the form of a hardware unit that has circuits that are manufactured or configured for a particular use. This type of hardware may perform operations without needing program code to be loaded into a memory from a storage device to be configured to perform the operations.

For example, when processor unit 304 takes the form of a hardware unit, processor unit 304 may be a circuit system, an application specific integrated circuit (ASIC), a programmable logic device, or some other suitable type of hardware configured to perform a number of operations. With a programmable logic device, the device is configured to perform the number of operations.

The device may be reconfigured at a later time or may be permanently configured to perform the number of operations. Examples of programmable logic devices include, for example, a programmable logic array, programmable array logic, a field programmable logic array, a field programmable gate array, and other suitable hardware devices. With this type of implementation, program code 318 may be omitted because the processes for the different embodiments are implemented in a hardware unit.

In still another illustrative example, processor unit 304 may be implemented using a combination of processors found in computers and hardware units. Processor unit 304 may have a number of hardware units and a number of processors that are configured to run program code 318. With this depicted example, some of the processes may be implemented in the number of hardware units, while other processes may be implemented in the number of processors.

As another example, a storage device in data processing system 300 is any hardware apparatus that may store data. Memory 306, persistent storage 308, and computer readable media 320 are examples of storage devices in a tangible form.

In another example, a bus system may be used to implement communications fabric 302 and may be comprised of one or more buses, such as a system bus or an input/output bus. Of course, the bus system may be implemented using any suitable type of architecture that provides for a transfer of data between different components or devices attached to the bus system. Additionally, a communications unit may include one or more devices used to transmit and receive data, such as a modem or a network adapter. Further, a memory may be, for example, memory 306, or a cache, such as found in an interface and memory controller hub that may be present in communications fabric 302.

Figure 4:
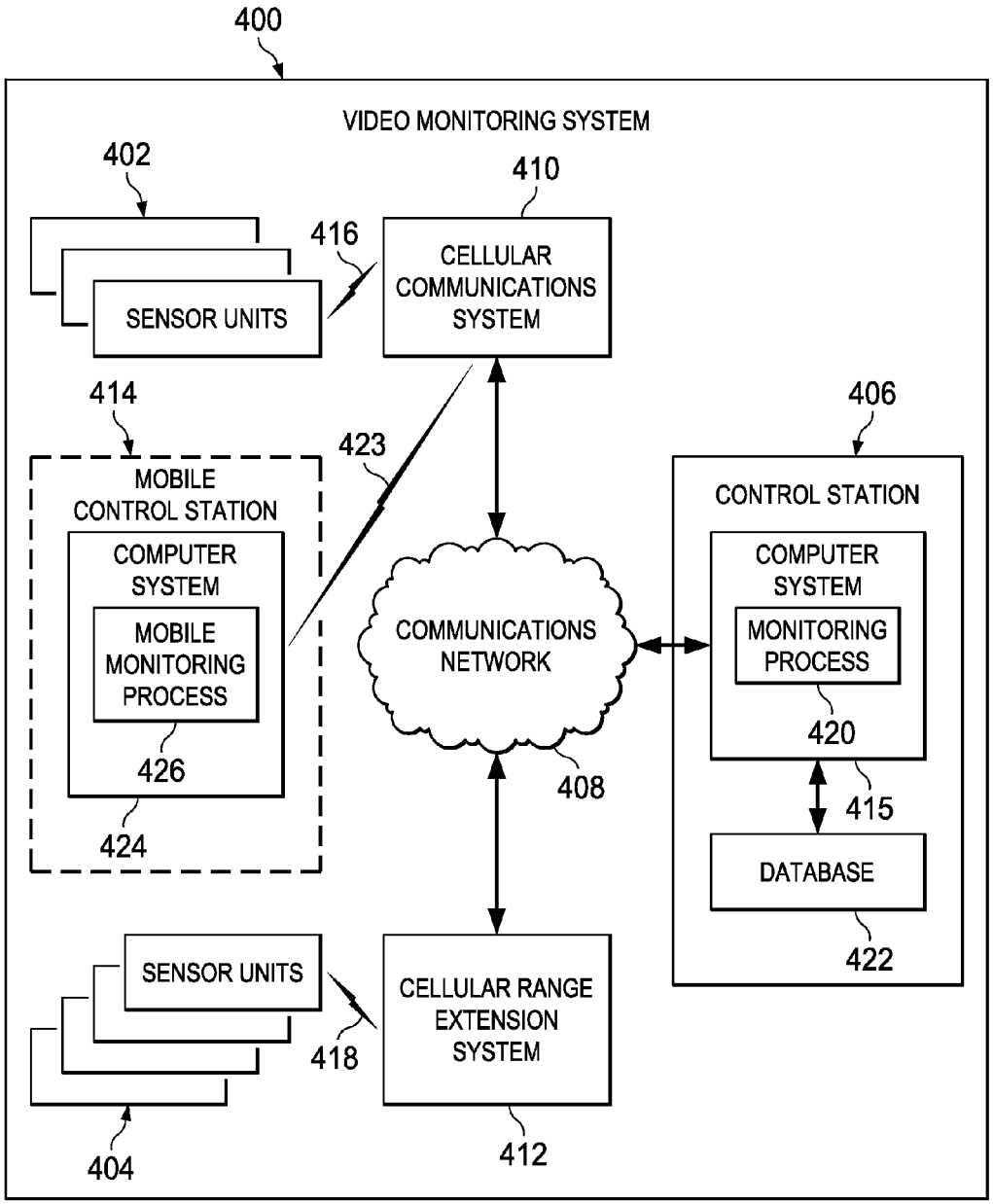
FIG. 4 is an illustration of a video monitoring system in accordance with an illustrative embodiment.

With reference now to FIG. 4, an illustration of a video monitoring system is depicted in accordance with an illustrative embodiment. In this illustrative example, video monitoring system 400 is an example of one implementation for video monitoring system 202 in FIG. 2. As depicted, video monitoring system 400 includes sensor units 402, sensor units 404, control station 406, communications network 408, cellular communications system 410, cellular range extension system 412, and mobile control station 414.

Sensor units 402 and sensor units 404 are examples of sensor unit 210 in FIG. 2. The different sensor units in sensor units 402 and sensor units 404 are configured to monitor different areas for a number of objects. The number of objects may be, for example, a number of vehicles. Sensor units 402 and sensor units 404 are configured to generate information that may be sent to control station 406 for processing.

In this depicted example, the information generated by sensor units 402 and sensor units 404 is sent to control station 406 in wireless signals using communications network 408. As one illustrative example, sensor units 402 send information in wireless communications link 416 to cellular communications system 410. Wireless communications link 416 is a cellular wireless link through which cellular wireless signals may be sent in this example.

As depicted, cellular communications system 410 is wirelessly connected to communications network 408. Communications network 408 may be, for example, the Internet. Cellular communications system 410 transmits the information generated by sensor units 402 to control station 406 through communications network 408.

In this illustrative example, sensor units 404 are at locations that are beyond a distance needed for transmitting wireless signals to control station 406. As a result, cellular range extension system 412 is needed to transmit the information generated by sensor units 404 to control station 406. Cellular range extension system 412 is an example of one implementation for range extension system 212 in FIG. 2.

In particular, sensor units 404 send the information in wireless signals to cellular range extension system 412 using wireless communications link 418. Cellular range extension system 412 then transmits this information in the wireless signals to control station 406 through communications network 408.

In this depicted example, control station 406 is located in a remote location to the locations of sensor units 402 and sensor units 404. Control station 406 is at a fixed location in this example. Control station 406 includes computer system 415. Monitoring process 420 runs on computer system 415. Monitoring process 420 is an example of monitoring process 270 in FIG. 2.

In some cases, monitoring process 420 processes the information received from sensor units 402 and/or sensor units 404. As one illustrative example, monitoring process 420 may store the information received in database 422.

Additionally, monitoring process 420 may compare the information received from the sensor units with information in database 422. For example, when video monitoring system 400 is configured to monitor for vehicles on roads, the information generated by sensor units 402 and sensor units 404 may include license plate numbers for vehicles detected on the roads. Monitoring process 420 may compare the license plate numbers in the information received from sensor units 402 and sensor units 404 with a list of license plate numbers in database 422. The list of license plate numbers may be a list of license plate numbers for vehicles of particular interest.

Further, monitoring process 420 may generate requests for additional information based on the information received from sensor units 402 and sensor units 404. As one illustrative example, monitoring process 420 finds a match between a particular license plate number identified in an image generated by a sensor unit and a license plate number in a list of license plate numbers for vehicles of particular interest in database 422.

In response to finding this match, monitoring process 420 generates a request for additional information. For example, monitoring process 420 may generate a request for a number of images taken before and after the image in which the particular license plate number was identified. The requests generated by monitoring process 420 are sent to sensor units 402 and sensor units 404 using communications network 408.

Still further, monitoring process 420 may use a number of rules, a policy, a set of parameters, and/or other suitable information stored in database 422 to process the information received from sensor units 402 and/or sensor units 404. For example, database 422 may include a specification for a make, a model, and a year for a particular vehicle of interest. Monitoring process 420 may compare the information received from sensor units 402 and sensor units 404 with this specification to determine whether the particular vehicle of interest is identified in the information.

Additionally, cellular communications system 410 may be configured to send the information generated by sensor units 402 to mobile control station 414 using wireless communications link 423. Mobile control station 414 includes computer system 424 with mobile monitoring process 426 running on the processor unit of computer system 424.

As one specific example, mobile control station 414 takes the form of a law enforcement vehicle. Mobile monitoring process 426 receives the information generated by sensor units 402 and processes this information to identify vehicles of particular interest, while the law enforcement vehicle is traveling on the roads in which sensor units 402 are located.

In this illustrative example, mobile monitoring process 426 may also receive information from control station 406 through communications network 408 and cellular communications system 410.

Figure 5:
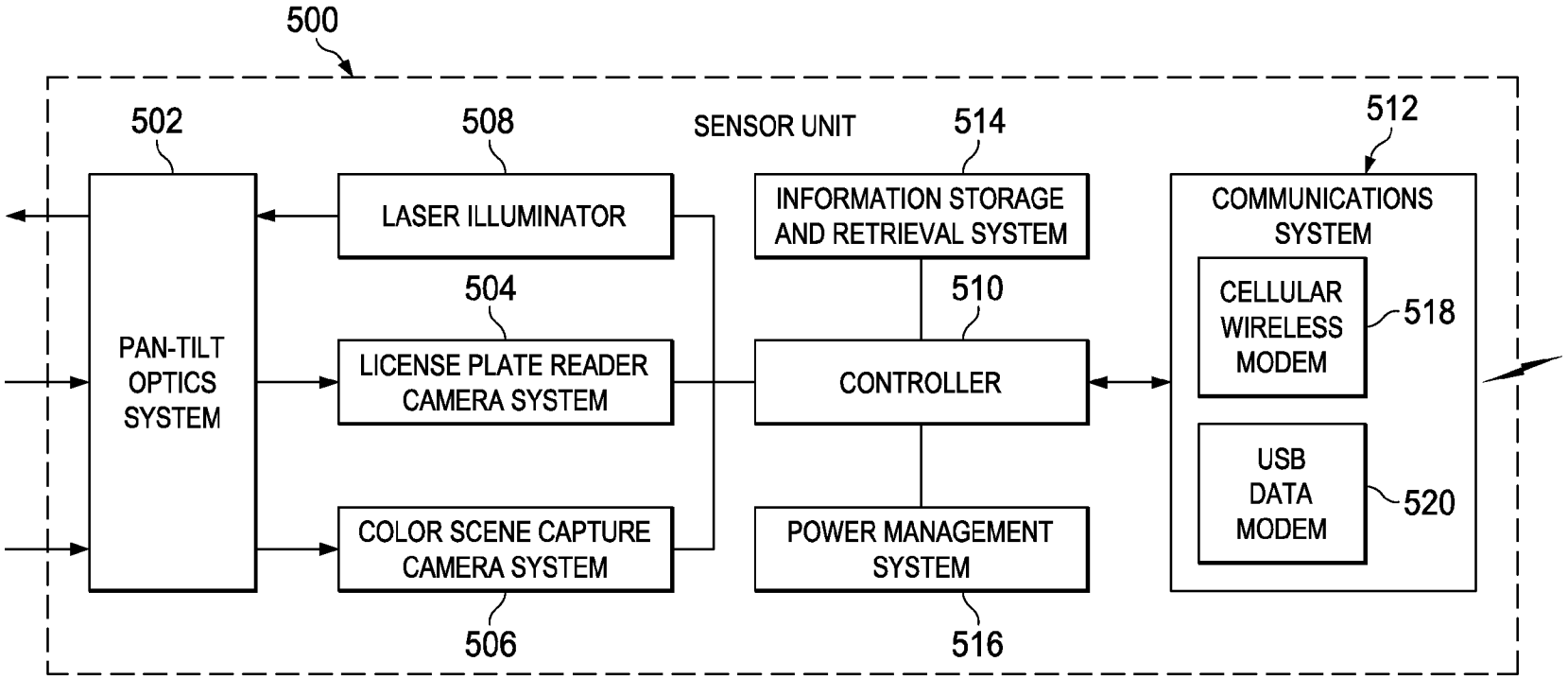
FIG. 5 is an illustration of a sensor unit in accordance with an illustrative embodiment.

With reference now to FIG. 5, an illustration of a sensor unit is depicted in accordance with an illustrative embodiment. In this illustrative example, sensor unit 500 is an example of one implementation for sensor unit 210 in FIG. 2. As depicted, sensor unit 500 includes pan-tilt optics system 502, license plate reader camera system 504, color scene capture camera system 506, laser illuminator 508, controller 510, communications system 512, information storage and retrieval system 514, and power management system 516.

In this depicted example, pan-tilt optics system 502 is configured to align license plate reader camera system 504 and color scene capture camera system 506. In particular, pan-tilt optics system 502 is configured to provide panning, tilting, and zoom capabilities for license plate reader camera system 504 and color scene capture camera system 506. License plate reader camera system 504 and color scene capture camera system 506 are examples of cameras in number of cameras 242 in camera system 228 in FIG. 2.

License plate reader camera system 504 is configured to generate a monochromatic image in this illustrative example. Further, license plate reader camera system 504 is configured to generate an image with responses to both visible light and near infrared light. Near infrared light has a wavelength from about 0.78 micrometers to about 3 micrometers.

Additionally, license plate reader camera system 504 has a field of view configured such that the image generated contains at least about 150 pixels across a width of a license plate. This image may then be processed using currently available processes for license plate character tracking and recognition.

Color scene capture camera system 506 is configured to provide a full color image with responses to both visible light and near infrared light. Further, color scene capture camera system 506 has a field of view that is about four times the size of the field of view for license plate reader camera system 504. The image generated by color scene capture camera system 506 is used to find and track a vehicle in the image.

In this illustrative example, pan-tilt optics system 502 provides a capability to adjust the pointing angles and zooming of license plate reader camera system 504 and color scene capture camera system 506. Additionally, license plate reader camera system 504 may be pointed at angles that are oblique relative to the license plates being detected in the images generated by license plate reader camera system 504. As a result, the shapes of the license plates in these images are not the rectangular shape of the license plates that are being detected. License plate character tracking and recognition software may be used to transform the shapes of the license plates in the images to the rectangular shapes. This transformation of the license plate shapes allows improved detection of the characters on the license plate by the license plate character tracking and recognition software.

In this depicted, example, laser illuminator 508 is an example of one implementation for light source 230 in FIG. 2. Laser illuminator 508 generates a laser beam that is directed towards a particular location using pan-tilt optics system 502. Further, laser illuminator 508 is associated with license plate reader camera system 504 in a fixed relationship. In other words, laser illuminator 508 moves with license plate reader camera system 504 as license plate reader camera system 504 is adjusted by pan-tilt optics system 502.

Images generated by license plate reader camera system 504 and color scene capture camera system 506 are sent to controller 510. Controller 510 may generate information, such as information 218 in FIG. 2, using these images. This information may include, for example, associations between license plate numbers and images.

These associations may be identified using, for example, without limitation, timestamps. As one illustrative example, a timestamp is associated with a license plate number. In particular, the timestamp is for a set of data from which the license plate number was identified. Further, the particular image in which the license plate number was identified is also associated with a timestamp. The timestamp associated with the license plate number and the timestamp associated with the particular image are associated with each other. The association of these two timestamps forms an association between the license plate number and the particular image in which the license plate number was identified.

In these illustrative examples, controller 510 sends the information generated by controller 510 to a computer system located remote to sensor unit 500 using communications system 512. The information may be sent to the computer system without intentional delays.

As depicted, communications system 512 includes cellular wireless modem 518 and universal serial bus (USB) data modem 520. Cellular wireless modem 518 is an example of one implementation for wireless communications system 234 in FIG. 2. Universal serial bus data modem 520 is an example of a wired communications system. As one specific example, a computer system may be connected to sensor unit 500 using a wired communications link. The information generated by controller 510 may be sent to the computer system using the wired communications link.

In some cases, the information generated by controller 510 is sent to information storage and retrieval system 514. Information storage and retrieval system 514 stores the information in, for example, packets. These packets are stored in buffers until a request is received by controller 510 for the information.

Additionally, power management system 516 in sensor unit 500 is configured to manage power usage for sensor unit 500. For example, power management system 516 may indicate that sensor unit 500 is to use a reduced amount of power during the night as compared to during the day. As one specific example, power management system 516 may control controller 510 such that controller 510 sends out information a reduced number of times during the night as compared to during the day.

In this illustrative example, power management system 516 may manage the power usage of sensor unit 500 according to a policy and/or number of rules.

Figure 6:
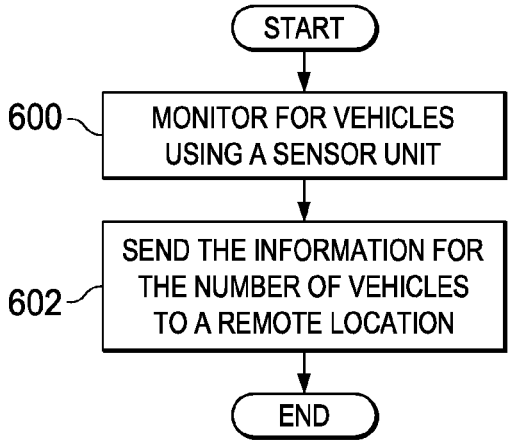
FIG. 6 is an illustration of a flowchart of a process for monitoring vehicles in accordance with an illustrative embodiment.

With reference now to FIG. 6, an illustration of a flowchart of a process for monitoring vehicles is depicted in accordance with an illustrative embodiment. The process illustrated in FIG. 6 may be implemented using a video monitoring system, such as video monitoring system 202 in FIG. 2 and/or video monitoring system 400 in FIG. 4.

The process begins by monitoring for vehicles using a sensor unit (operation 600). The sensor unit may be, for example, sensor unit 210 in FIG. 2 and/or sensor unit 500 in FIG. 5. The sensor unit is configured to generate information for the number of vehicles using images generated by a camera system in the sensor unit. This information may be, for example, information 218 in FIG. 2. In particular, the information may include selected images from the images generated by the camera system, license plate numbers of vehicles, timestamps, and/or other suitable types of information.

Thereafter, the process sends the information for the number of vehicles to a remote location (operation 602), with the process terminating thereafter. In operation 602, the remote location may be a control station having a computer system, such as computer system 214 in FIG. 2.

Figure 7:
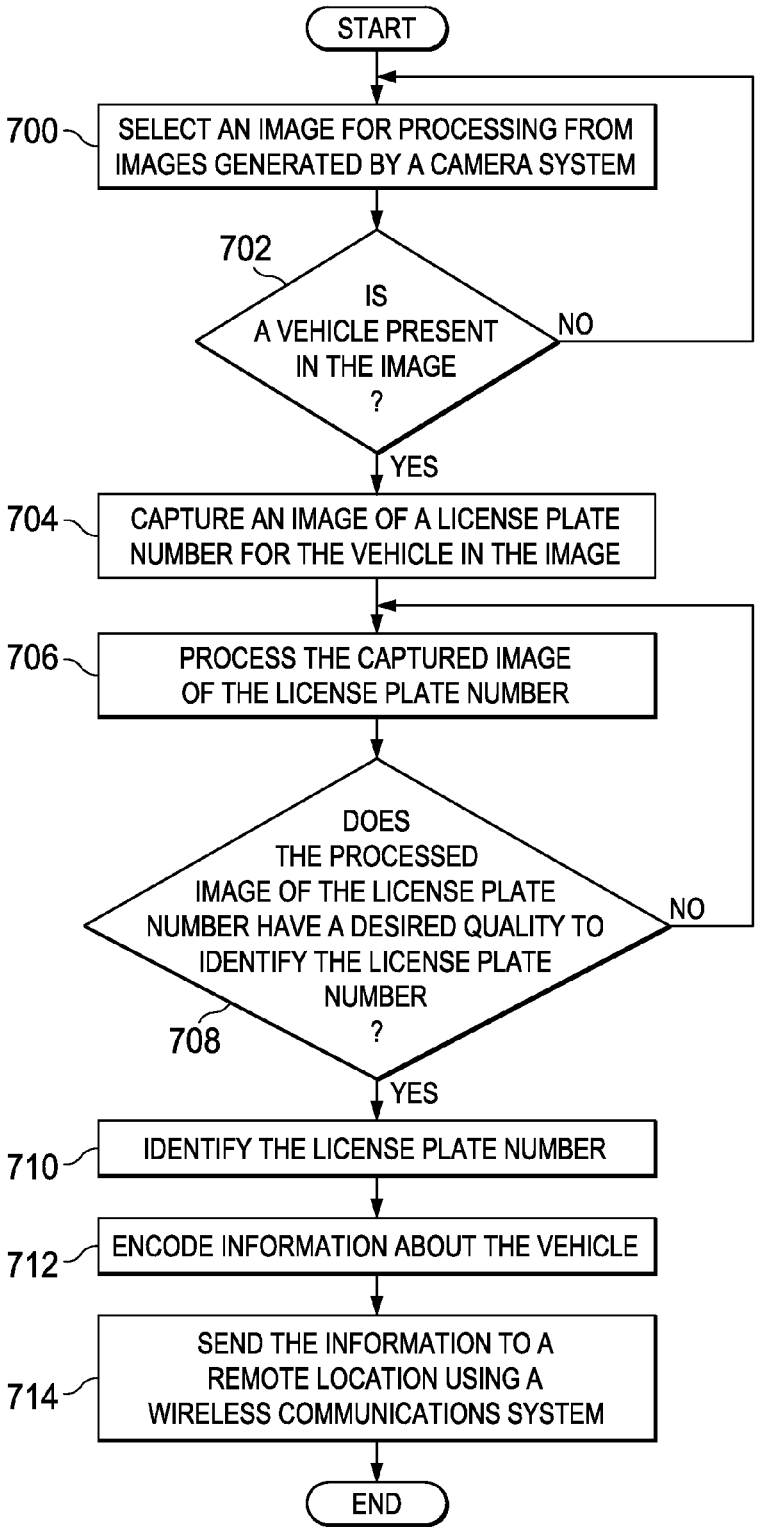
FIG. 7 is an illustration of a flowchart of a process for monitoring for vehicles in accordance with an illustrative embodiment.

With reference now to FIG. 7, an illustration of a flowchart of a process for monitoring for vehicles is depicted in accordance with an illustrative embodiment. The process illustrated in FIG. 7 may be implemented using a sensor unit, such as sensor unit 210 in FIG. 2 and/or sensor unit 500 in FIG. 5.

The process begins by selecting an image for processing from images generated by a camera system (operation 700). The images are generated using, for example, camera system 228 in sensor unit 210 for video monitoring system 202 in FIG. 2. In particular, these images may be generated using color scene capture camera system 506 in FIG. 5. The process then determines whether a vehicle is present in the image (operation 702). If a vehicle is not present in the image, the process returns to operation 700 as described above. The next image selected in operation 700 is the image taken after the first image is selected in operation 700.

With reference again to operation 702, if a vehicle is present in the image, the process captures an image of a license plate number for the vehicle in the image (operation 704). In operation 704, images are generated using, for example, license plate reader camera system 504 in FIG. 5. Further, these images are searched for shapes representing license plates and for characters for license plates to capture the image of the license plate number for the vehicle.

Thereafter, the captured image of the license plate number is processed (operation 706). Operation 706 may be performed using currently available license plate reading software. Further, operation 706 may be performed using software configured to recognize shapes for license plates and characters for license plates. In this manner, a license plate number may be detected from the captured image.

Next, the process determines whether the processed image of the license plate number has a desired quality to identify the license plate number (operation 708). A processed image of the license plate number has the desired quality when the license plate number has been detected at least a selected number of times. In other words, the processed image of the license plate number has the desired quality when the license plate number has been detected in the processed image and in images processed prior to the processed image a selected number of times. This selected number of times may be, for example, three times.

If the processed image of the license plate number does not have the desired quality, the process returns to operation 706. Otherwise, the process identifies the license plate number (operation 710). In these examples, a license plate number may include numbers, letters, and/or other types of characters. The process then encodes information about the vehicle (operation 712). This information includes the identification of the license plate number, the timestamp for the image selected in operation 700, the timestamp for the processed image in which the license plate number was identified, and/or other suitable information.

Thereafter, the process sends the information to a remote location using a wireless communications system (operation 714), with the process terminating thereafter.

Figure 8:
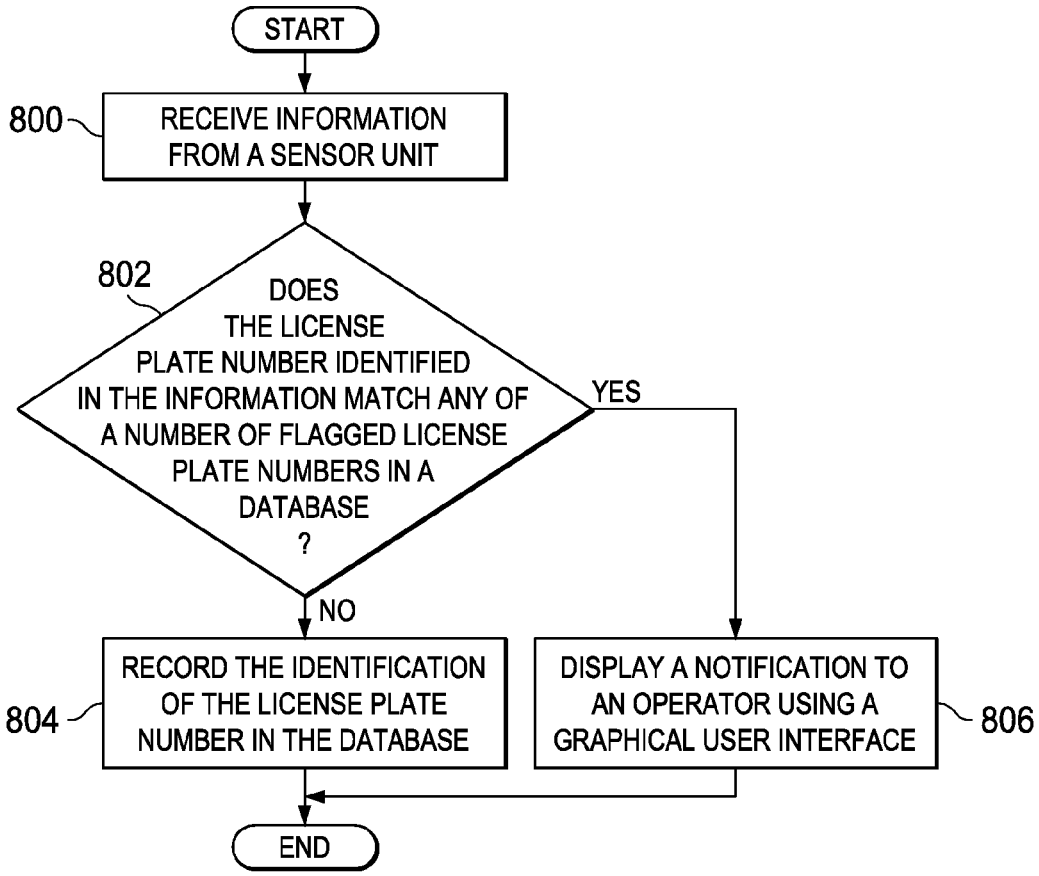
FIG. 8 is an illustration of a flowchart of a process for processing information received from a sensor unit in accordance with an illustrative embodiment.

With reference now to FIG. 8, an illustration of a flowchart of a process for processing information received from a sensor unit is depicted in accordance with an illustrative embodiment. The process illustrated in FIG. 8 may be implemented using a computer system, such as computer system 214 in FIG. 2.

The process begins by receiving information from a sensor unit (operation 800). This information may be, for example, the information encoded in operation 712 in FIG. 7 and sent from the sensor unit in operation 714 in FIG. 7. This information includes the identification of a license plate number for a vehicle, a timestamp for the image in which the vehicle was detected, a timestamp for the processed image in which the license plate number was identified, and/or other suitable information.

Thereafter, the process then determines whether the license plate number identified in the information matches any of a number of flagged license plate numbers in a database (operation 802). The number of flagged license plate numbers in the database may be, for example, license plate numbers that have been identified as threats or as associated with vehicles of interest.

If the license plate number identified in the information does not match any of the number of flagged license plate numbers in the database, the process records the identification of the license plate number in the database (operation 804), with the process terminating thereafter. In operation 804, the process may record the identification of the license plate number in a general logging section of the database.

With reference again to operation 802, if the license plate number identified in the information does match a flagged license plate number in the number of flagged license plate numbers in the database, the process displays a notification to an operator using a graphical user interface (operation 806), with the process terminating thereafter.

In operation 806, the notification may include the license plate number. The user may perform a number of actions in response to the display of notification and the license plate number. For example, if the license plate number was flagged as a threat, the user may notify security that the license plate number was detected. Additionally, the user may request further information from the video monitoring system. For example, the user may request that the color scene capture image generated at or around the time at which the license plate number was detected also be displayed.

The flowcharts and block diagrams in the different depicted embodiments illustrate the architecture, functionality, and operation of some possible implementations of apparatus and methods in different illustrative embodiments. In this regard, each block in the flowchart or block diagrams may represent a module, segment, function, and/or a portion of an operation or step. In some alternative implementations, the function or functions noted in the block may occur out of the order noted in the figures. For example, in some cases, two blocks shown in succession may be executed substantially concurrently, or the blocks may sometimes be executed in the reverse order, depending upon the functionality involved. Also, other blocks may be added in addition to the illustrated blocks in a flowchart or block diagram.

Thus, the different illustrative embodiments provide a method and apparatus for monitoring for vehicles. A sensor unit comprises a housing, a camera system, a light source, a lens system, a wireless communication system, a controller, and a power source. The camera system, the light source, the lens system, the wireless communication system, the controller, and the power source are associated with the housing.

The camera system has a field of view and is configured to generate images. The light source is configured to generate a light beam that is substantially collimated in these illustrative examples. The lens system is associated with the light source and is configured to cause the light beam to diverge with an angle that covers the field of view for the camera system. The wireless communication system is configured to transmit wireless signals. The controller is configured to detect a number of vehicles in the images, generate information for the number of vehicles, and send the information in the wireless signals transmitted by the wireless communication system. The power source provides power to the camera system, the light source, the controller, and the wireless communications system.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different advantages as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus for obtaining an image of a vehicle comprising:

a housing that is portable;

a camera system associated with the housing and comprising a license plate reader camera and a color scene capture camera, the color scene capture camera having a first field of view about four times a size of a second field of view of the license plate reader camera, and configured to generate images;

a light source associated with the housing and configured to generate a light beam that is substantially collimated, the light source comprising a laser unit and the light beam comprising a laser, the light source and laser beam configured to illuminate the vehicle such that the camera system may generate an image of a license plate of the vehicle at a distance up to and including 200 meters away from the light source;

a lens system associated with the light source and configured to cause the light beam to diverge with an angle that covers the field of view for the camera system;

a wireless communications system associated with the housing and configured to transmit wireless signals;

a controller associated with the housing and configured to detect a number of vehicles in the images, generate information for the number of vehicles, and send the information in the wireless signals transmitted by the wireless communications system; and a power source associated with the housing configured to provide power to the camera system, the light source, the wireless communications system, and the controller, and wherein the camera system, light source, lens system, wireless communication system, power source, and controller are physically connected to the housing;

a first timestamp associated with a set of data from which the license plate number was identified; and a second timestamp associated with a particular image in which the license plate number was identified;

wherein the first timestamp and the second timestamp are associated with each other to form an association between the license plate number and the particular image in which the license plate number was identified.

2. The apparatus of claim 1 further comprising:

a range extension system configured to receive the wireless signals from the wireless communications system, amplify the wireless signals received from the wireless communications system, and transmit the wireless signals that have been amplified.

3. The apparatus of claim 1 further comprising:

a computer system in a remote location to a location of the housing, wherein the computer system is configured to receive the information in the wireless signals transmitted by the wireless communications system.

4. The apparatus of claim 1, further comprising:

an optics system that adjusts pointing angles and zooming of the license plate reader camera and the color scene capture camera, wherein the license plate reader camera may be pointed at angles that are oblique relative to license plates detected in the images generated by license plate reader camera;

wherein the controller is configured to identify license plate numbers for the number of vehicles in generating the information and to transform shapes of the license plates in the images to rectangular shapes; and wherein the housing is configured for placement of the housing on a power line.

5. The apparatus of claim 4, wherein the information including the license plate numbers for the number of vehicles is sent in the wireless signals as the information is generated without any delay other than a delay for the time needed to place license plate numbers in packets for transmission in the wireless signals, and the time needed to place the packets in buffers until the packets can be transmitted.

6. The apparatus of claim 5, the controller is configured to place an image from the images in the information periodically.

7. The apparatus of claim 3, wherein the housing, the camera system, the light source, the lens system, the controller, the wireless communications system, and the power source form a sensor unit positioned within the housing, and wherein the computer system is further configured to identify a particular vehicle of interest in the information received from the sensor unit, send a request to the sensor unit for a number of images for the particular vehicle of interest, and receive the number of images for the particular vehicle of interest from the sensor unit.

8. The apparatus of claim 1, wherein the number of vehicles is selected from one of a number of vehicles detected in the images and a number of vehicles detected in the images that have license plate numbers that match a group of license plates numbers.

9. The apparatus of claim 1, wherein the power source is selected from at least one of a fuel cell, a battery, an energy harvesting device, a thermoelectric generator, a micro wind turbine system, and a solar cell system.

10. The apparatus of claim 1, wherein the light beam has a wavelength selected from one of about 380 nanometers to about 780 nanometers and from about 0.7 micrometers to about 300 micrometers.

11. An apparatus configured to monitor remotely vehicles in traffic, the apparatus comprising:

a housing that is portable;

a camera system associated with the housing and comprising a license plate reader camera and a color scene capture camera, the color scene capture camera having a first field of view about four times a size of a second field of view of the license plate reader camera, and configured to generate images;

an optics system that adjusts pointing angles and zooming of the license plate reader camera and the color scene capture camera, wherein the license plate reader camera may be pointed at angles that are oblique relative to license plates detected in the images generated by license plate reader camera;

a light source associated with the housing and configured to generate a light beam that is substantially collimated, the light source comprising a laser unit and the light beam comprising a laser, the light source and laser configured to illuminate a vehicle such that the camera system may generate an image a license plate of the vehicles at a distance up to and including 200 meters away from the light source;

a wireless communications system associated with the housing and configured to transmit wireless signals;

a controller associated with the housing and configured to detect a number of vehicles in the images, identify license plate numbers for the number of vehicles, send the license plate numbers in the wireless signals sent by the wireless communications system, receive a request for a number of images for a particular vehicle of interest in the number of vehicles from a requestor, and send the number of images for the particular vehicle of interest to the requestor;

a power source associated with the housing configured to provide power to the camera system, the controller, and the wireless communications system, and wherein the camera system, light source, lens system, wireless communication system, power source, and controller are positioned substantially within the housing and are physically connected to the housing;

a first timestamp associated with a set of data from which the license plate number was identified; and a second timestamp associated with a particular image in which the license plate number was identified;

wherein the first timestamp and the second timestamp are associated with each other to form an association between the license plate number and the particular image in which the license plate number was identified; and wherein the controller is configured to transform shapes of the license plates in the images to rectangular shapes.

12. The apparatus of claim 11, wherein the license plate numbers for the number of vehicles are sent in the wireless signals as the license plate numbers are identified without any delay other than a delay for the time needed to place license plate numbers in packets for transmission in the wireless signals, and the time needed to place the packets in buffers until the packets can be transmitted.

13. The apparatus of claim 11, wherein the controller is configured to send an image from the images in the wireless signals periodically.

14. The apparatus of claim 11 further comprising:

a lens system associated with the light source and configured to cause the light beam to diverge with an angle that covers a field of view for the camera system.

15. A method for monitoring for vehicles, the method comprising:

monitoring for the vehicles using a sensor unit comprising a housing that is portable; a camera system associated with the housing and comprising a license plate reader camera and a color scene capture camera, the color scene capture camera having a first field of view about four times a size of a second field of view of the license plate reader camera, and configured to generate images; a light source associated with the housing and configured to generate a light beam that is substantially collimated, the light beam comprising a laser; a lens system associated with the light source and configured to cause the light beam to diverge with an angle that covers the field of view for the camera system; an optics system that adjusts pointing angles and zooming of the license plate reader camera and the color scene capture camera, wherein the license plate reader camera may be pointed at angles that are oblique relative to license plates detected in the images generated by license plate reader camera; a wireless communications system associated with the housing and configured to transmit wireless signals; a controller associated with the housing and configured to detect a number of vehicles in the images, generate information for the number of vehicles, and send the information in the wireless signals transmitted by the wireless communications system; and a power source associated with the housing configured to provide power to the camera system, the light source, the controller, and the wireless communications system, and wherein the camera system, light source, lens system, power source, optics system, wireless communication system, and controller are physically connected to the housing and are positioned within the housing, the monitoring with the light source and the laser configured such that the camera system may generate an image of the license plate of vehicles at a distance up to and including 200 meters away from the light source; and sending the information for the number of vehicles to a remote location;

wherein the controller is configured to transform shapes of the license plates in the images to rectangular shapes;

wherein the controller is further configured to associate a first timestamp with a set of data from which the license plate number was identified and to associate a second timestamp with a particular image in which the license plate number was identified; and wherein the first timestamp and the second timestamp are associated with each other to form an association between the license plate number and the particular image in which the license plate number was identified.

16. The method of claim 15 further comprising:

generating, by the camera system, the images;

generating, by the controller, the information for the number of vehicles using the images generated by the camera system wherein the controller is configured to identify license plate numbers for the number of vehicles in generating the information and wherein the information including the license plate numbers for the number of vehicles is sent in the wireless signals as the information is generated without any delay other than a delay for the time needed to place license plate numbers in packets for transmission in the wireless signals, and the time needed to place the packets in buffers until the packets can be transmitted; and transmitting, by the controller, the information generated in the wireless signals to the remote location using the wireless communications system.

17. The method of claim 16, wherein the step of transmitting, by the controller, the information generated in the wireless signals to the remote location using the wireless communications system comprises:

transmitting, by the controller, the information in the wireless signals to a range extension system using the wireless communications system; and transmitting, by the range extension system, the information in the wireless signals to the remote location.

18. The method of claim 15 further comprising:

receiving the information from the sensor unit;

processing the information received from the sensor unit using a database;

generating a number of requests for additional information; and sending the number of requests for the additional information to the sensor unit.

19. The apparatus of claim 1, wherein the light source is configured such that the camera system generates images for the number of vehicles up to about 200 meters.

20. The method of claim 16, further comprising generating by the camera system the images for the number of vehicles up to and including 200 meters.

21. The method of claim 15 further comprising concealing the housing from vehicles to be monitored.

22. The method of claim 15 further comprising concealing the housing in a tree.

23. The method of claim 15 further comprising concealing the housing in a pole.

24. The apparatus of claim 1 further comprising a pan tilt optics system associated with the camera system and the lighting system, the pan tilt optics system configured to provide panning, tilting, and zoom capabilities for the camera system so as to read license plate information.

25. The apparatus of claim 24, wherein the camera system has a field of view configured such that an image generated is a monochromatic image and contains at least about 150 pixels across a width of a license plate.

26. The apparatus of claim 11, wherein the housing is configured for placement of the housing on a power line.

27. The method of claim 15, wherein the housing is configured for placement of the housing on a power line.

* * * * *